United States Patent [19]

Yano et al.

[11] 4,090,676

[45] May 23, 1978

[54] YARN OR THREAD GUIDING DEVICE

[75] Inventors: Matsunosuke Yano, Osaka; Toshio Yajima, Toyonaka; Terukazu Ohta, Ikeda, all of Japan

[73] Assignee: Kamitsu Seisakusho, Ltd., Japan

[21] Appl. No.: 625,881

[22] Filed: Oct. 28, 1975

Related U.S. Application Data

[63] Continuation-in-part of Ser. No. 454,116, Mar. 25, 1974, abandoned.

[51] Int. Cl.[2] ..... B65H 54/06; B65H 54/22

[52] U.S. Cl. ..... 242/18 DD; 242/35.6 R; 242/43.2

[58] Field of Search ..... 242/35.6 R, 18 DD, 18 R, 242/26, 43.2, 35.6 E, 35.5 R

[56] References Cited

U.S. PATENT DOCUMENTS

| | | | |
|---|---|---|---|
| 1,588,822 | 6/1926 | Swan | 242/26 |
| 2,171,758 | 9/1939 | McKean | 242/18 R |
| 3,346,205 | 10/1967 | Jenny | 242/43.2 |

FOREIGN PATENT DOCUMENTS

| | | | |
|---|---|---|---|
| 1,074,772 | 7/1967 | United Kingdom | 242/18 DD |

*Primary Examiner*—Stanley N. Gilreath

[57] ABSTRACT

A device which prevents the lateral throw-off of loose yarn ends from a yarn package on a winding machine, a package is driven in contact with a rotating member, and such device consists of at least one blowing nozzle arranged at the outside of an end face of the package so that the direction of the air current blown out from said nozzle is directed toward the contact point between the end face of the package and the rotating member. In a preferred embodiment, air is directed parallel to the junction of the winding yarn package and a grooved guide drum, substantially a right angle to the package end face.

5 Claims, 17 Drawing Figures

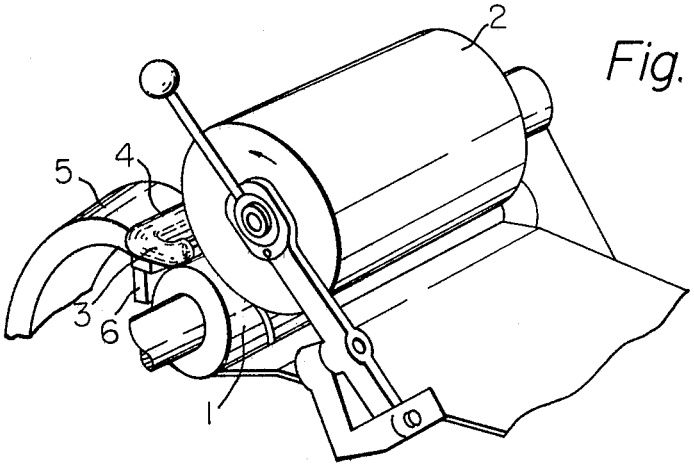
Fig. 3
Fig. 4
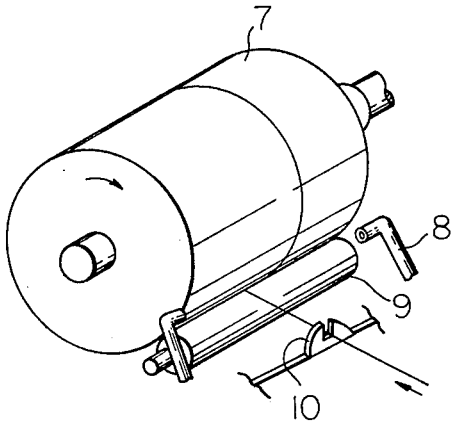
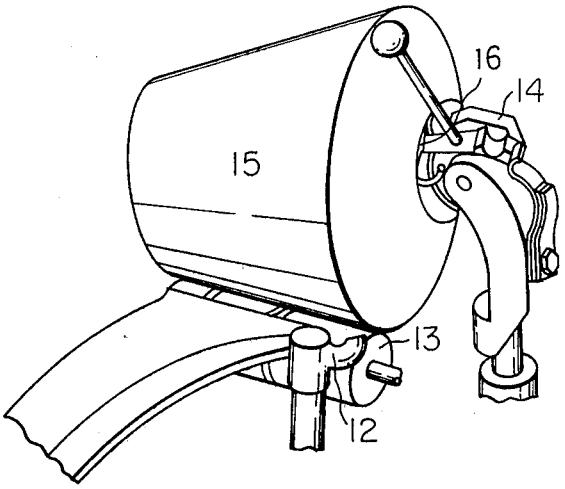
Fig. 5

YARN OR THREAD GUIDING DEVICE

CROSS REFERENCE

This is a continuation-in-part of copending U.S. application Ser. No. 454,116, filed Mar. 25, 1974, now abandoned.

The present invention relates to a device for producing cross-wound packages of yarn, such as cheese or cones.

More particularly, the present invention relates to a device for preventing the throwing off of yarn from the yarn package when the yarn breaks or the supply yarn is depleted, and also for preventing the occurrence of so-called throw-off turns or drop-off turns on a winding machine on which a package is driven in contact with a rotating member.

In order to produce the crosswise helical turns of such packages, the yarn, as it runs onto the takeup spool to form the package, is being reciprocated axially along the package. Due to the reciprocating motion, it may happen that in the event of yarn interruption, such as when the yarn breaks or the supply is depleted, the loose yarn end will fly laterally over the axial ends of the package and then form so-called throw-offs or drop-off turns, and quite often they become entangled with the journal of package holder or another part of machine. This makes it difficult and time consuming to subsequently seek and seize the yarn. Particularly in winding machines equipped with automatic yarn seeking and knotting devices, the proper continuance of operation is then possible in most cases only upon intervention of attending personnel.

For eliminating drop-off turns many methods have been proposed so far. For example, the device depicted in U.S. Pat. No. 3,279,713 is so designed that it consists of a slotted braking member arranged at the front of the traverse mechanism, which acts as a braking member against the yarn with a kinetic energy at the time of yarn interruption.

As an another example, the device depicted in U.S. Pat. No. 3,346,205 employs air current generated from a blower or ventilator which is constructed at the ends of grooved drum. The air current blows from both ends of the grooved drum toward the middle region of the yarn package, so that the free end of the yarn can be directed by said air current toward the middle of the package being wound, when yarn breaks or yarn depletion occurs.

As yet another example, British patent No. 1,074,772 to Reiners describes a system wherein air currents are directed substantially tangentially both of the bobbin end at the point of entry of the thread and of the base of the guide drum channel at the point of exit of the thread. In this way, each air current is caused to sweep chordally over a portion of one of the bobbin ends adjacent the end thereof.

However, even in the above described devices, the above mentioned undesirable condition cannot be completely eliminated. The reason is that, to wind good cross wound package of yarn on a winding machine, the traverse length of the yarn, which is traversed by any type of mechanical traverse means such as a grooved drum, must be longer than the axially actual length of yarn layer of the package, because the yarn is drawn toward the center of the package in the axial direction under the influence of the component force along the surface of the drum; therefore, in other words, the traverse length of the latter is shorter than that of the former. And in the actual winding operation if the yarn winding tension happens to drop suddenly and temporarily, a yarn at the extremity of traverse will happen to form a stitch of yarn on the end face of package so-called "stitching" or "cobwebbing." According to the similar reason as mentioned above, at the time of yarn breakage or the supply yarn depletion or going to be depleted, the winding tension is lost, and so if the above phenomenon occurs at the moment when the yarn happens to be delivered at the extremity of traverse, the yarn is not drawn toward the end face of package which is being wound, but it drops off from the end face of the package. The stronger the winding tension or the higher the winding speed, such a drop-off turn occurs more frequently.

In the device of the U.S. Pat. No. 3,279,713, the yarn becomes free after passing through the slotted braking member, therefore the yarn, which is traversed by a mechanical traverse means, does not have the component force which draws the yarn back to the end face of the package, and so the yarn is likely to drop off from the package, especially if it is located at the extremity of traverse.

In the device of the U.S. Pat. No. 3,346,205, it has a tendency to bring the end of yarn toward the center of the package, however, considering the structure of the above device it does not have a constant or sufficient air stream. By the above air stream the yarn (not the free end of yarn) being traversed by a mechanical traverse means, especially positioned at the extremity of the traverse is not drawn toward the center of the package along the surface of the drum. And moreover the air stream of the above device depends on the revolutions of the grooved drum, so that the adjustment of air stream is not settled easily.

In the British patent No. 1,074,772, the function of the air current occurs during reverse turning of the package so that the yarn on the package is then being uncoiled.

The devices described in the above mentioned patents are the means for preventing the drop-off turn of the free end of yarn and they are not described in point of view of the length difference between the yarn traverse length by a mechanical means and actual length of the package, therefore at the moment when the yarn tension is lost, the yarn has already been dropped off from the package. In addition, with the device in U.S. Pat. No. 3,346,205 there is a drawback of low efficiency of air current, and sometimes it lacks stability. And to make the drum in which the blowing means are constructed at both ends, high manufacturing cost cannot be avoided.

The object of the present invention is to provide an effective device for preventing the occurrence of the throwing off of the yarn end from the yarn package.

Another important object of the present invention has reference to an improved yarn guide mechanism which positions the broken yarn end at a winding station in a location where it can be effectively seized by a yarn catcher or finder so that it can be subjected to a knotting operation.

DESCRIPTION OF THE DRAWINGS

Further features and advantages of the present invention will be made clear from the ensuing description, references being made to the accompanying drawings, wherein:

FIG. 3 is a perspective view of the device shown in FIGS. 1 and 2;

FIG. 4 is a perspective view of another embodiment of the device of the present invention used for a spindle drive type winding machine with a roller bail;

FIG. 5 is a perspective view of another embodiment of the device of the present invention used for automatic winding machine provided with a package holder of a single arm type.

DETAILED DESCRIPTION

Figure 1:
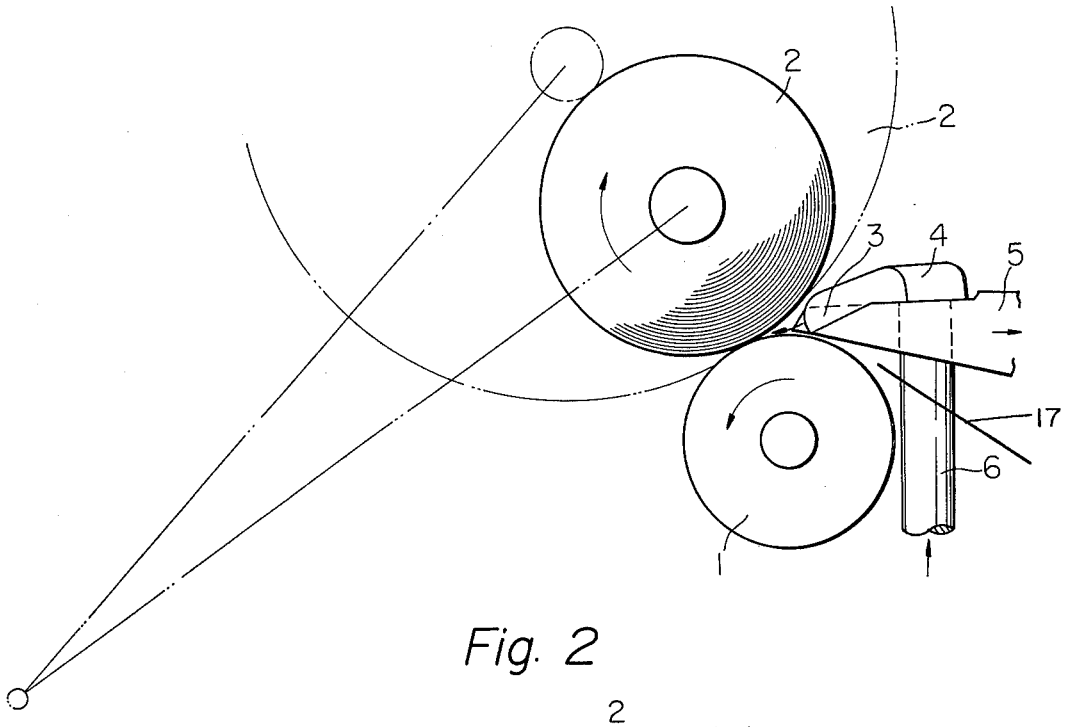
FIG. 1 is a schematically sectional side view of the device of the present invention used for a drum type automatic winding machine.
Figure 2:
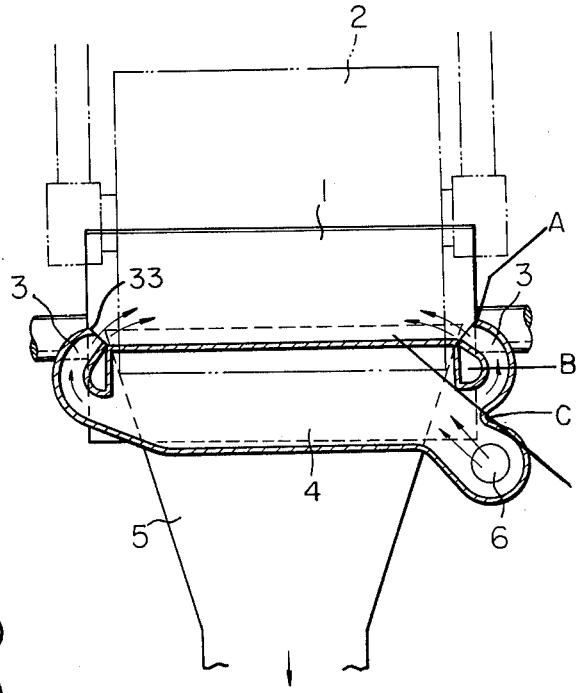
FIG. 2 is a schematically and partially sectional plan view of the device shown in FIG. 1, and FIGS. 2A, 2B, and 2C are cross sectional views of said suction nozzle, taken along lines A, B, and C in FIG. 2, respectively.
Figure 14A:
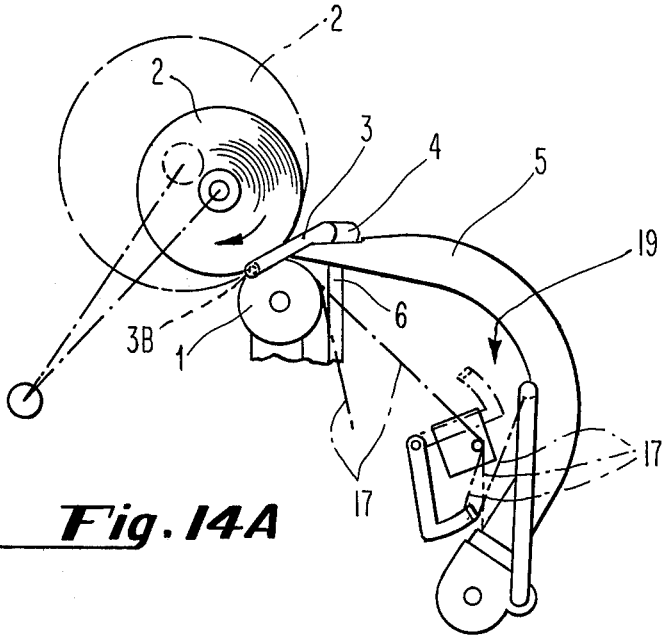
FIG. 14A is a view in perspective showing another embodiment of the present invention, in which the blowing nozzles are arranged in the back of the contact line defined by the contact between the package and the rotating member.

As shown in FIGS. 1 and 2, the automatically operating yarn seeking device includes nozzle 5 and is also used for automatic knotting operations. As to the automatic knotting operation for automatic winders (such as, knotter 19 in FIG. 14A), many methods have been proposed, so no detailed presentation thereof is set forth herein. In short, however, at the time of the automatic knotting operation, the automatically operating yarn seeking device, which includes the suction nozzle 5, seeks and seizes a package yarn end and conveys it to a knotting device 19. The structure and operation of automatic knotter 19 is disclosed in U.S. Pat. Nos. 3,343,756 and 3,399,840. The numeral 17 shows a running yarn. As to the automatic winder, particularly relating to the suction nozzle, many proposals have beem made, and so there is no detailed explanation herein. An air chamber 4 is fixedly mounted on said nozzle 5. The air chamber 4 is connected to an air source (not shown) by means of a connecting pipe 6. Blowing nozzles 3 which are connected to said air chamber 4 are provided at the both sides of the package and outside the end faces of package. The air currents blown out continuously from said nozzles 3 are directed toward the contact point between the end faces of the package 2 and the grooved drum 1. The air current passes through the nozzle 3 of which cross section is gradually decreased in size from the portion adjacent to the air chamber 4 to the blowing outlet 33 of said nozzle 3. The air current is directed toward the contact point between the package and the rotating member, approximately at a right angle to the end face of the package in the axial direction of the package. In the embodiment as shown in FIGS. 1, 2, and 3 the blowing nozzles 3 are positioned outside and in front of the contact line defined by the contact between the package 2 and the rotating member 1, toward the yarn path leading to the package, but in another arrangement (shown in FIG. 14A) the nozzles 3B can also be arranged outside and at the backside of the contact line defined by the contact between the package 2 and the rotating member 1, said nozzle being disposed at the opposite side of or backside of the contact line, between the package 2 and the rotating member 1, and away from the yarn path leading to the package 2.

In FIG. 1, for example, when the yarn is wound on the spool to form the package 2 with crosswise helical turns, the yarn is moved reciprocally by the rotating member 1, which is provided with two helical grooves. These two helical grooves meet at both terminal areas of the rotating member 1, and yarn 17, which is guided by the helical grooves and is always displaced toward either of said terminal areas. After arriving at the end of the contact line defined by the contact between rotating member 1 and package 2, the yarn 17 is shifted by said groove toward its reciprocating direction, and then said yarn 17 runs away from said terminal area.

Figure 2A:
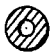
Figure 2B:
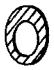
Figure 2C:
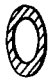
Figure 12:
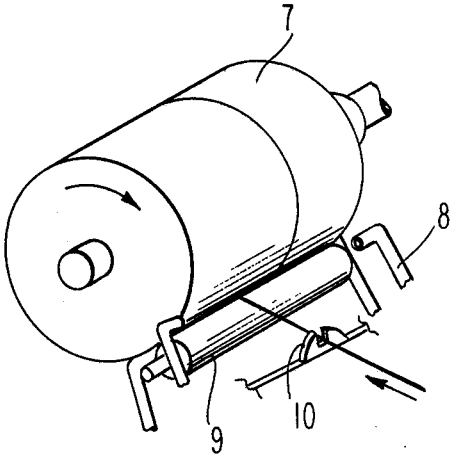
Figure 13:
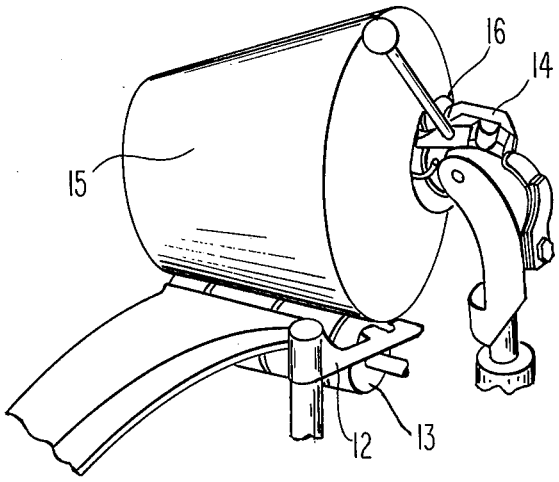

The area wherein the yarn is running towards the terminal areas, is disposed at the backside of the contact line between package 2 and the rotating member 1, as shown in U.S. Pat. No. 3,279,713. If the air current is directed toward the end of the contact line, the nozzles 3B arranged outside and just down stream of the contact line between package 2 and rotating member 1 (above-described "backside") will have the same results as the nozzles 3A arranged outside and just up stream of the contact line (above-described "front side"). This reciprocating movement can also be utilized in the spindle drive type winding machine shown in FIGS. 4 and 12. Preferably, the cross section of the blowing nozzle 3 is gradually decreased in size from said air chamber 4 to the blowing outlet 33 as shown in FIGS. 2C through 2A. Furthermore a plurality of nozzles 3 may be arranged at both the front and the back of the contact point and said nozzle or nozzles are arranged so that an air current blows approximately perpendicular to the end face of the wound package, and it is directed at the contact point between the package and the grooved drum. In other words, said nozzle or nozzles blow continuously during the winding operation in order to shift the free end of the package yarn having no winding tension from the both extremities of traverse toward the middle of the traverse in the axial direction of the package.

According to the above embodiment, the air current blown out continuously from the nozzle 3 is directed toward the contact point between the grooved drum 1 and the package 2. Therefore, at the time of yarn breakage or supply yarn depletion or going to be depleted, the winding tension is lost, and even if the yarn happen to position at the extremity of traverse, the yarn is brought toward the end face of package by the air current blown out from the nozzle 3.

By the arrangement shown in FIGS. 1 through 3, the lateral throw off of a loose end of a yarn from the yarn package can be completely prevented. Therefore it is easy to seek and seize the yarn end for the purpose of knotting it together with the yarn supply. Moreover, there is no useless work of an operator to eliminate the yarn end entangled with the journal of the package holder, so operator productivity becomes higher. Particularly in automatic winding machines equipped with automatically operating yarn seeking and knotting device, knotting failure owing to inability to seize the yarn at the end of the package can be avoided so the working efficiency of machine becomes higher.

Another embodiment of the present invention is shown in FIG. 4, which shows the different type of winding machine called a spindle winder. In FIG. 4, 7 is a package, 8 is a blowing nozzle, 9 is a roller bail which is frictionally driven by the package 7, and 10 is a yarn guide which is mounted on a traverse mechanism (not shown). It has no suction nozzle, so the blowing nozzles 8 as shown in FIGS. 1, 2 and 3 are arranged to the frame of machine by proper means. The air current blown out continuously from the nozzle 8 is directed toward the contact point between the package 7 and the roller bail 9.

FIG. 5 shows another embodiment of the present invention. In FIG. 5, 13 is a grooved drum, 14 is a package holder of a single arm type and 15 is a wound package. The package 15 is formed on a taper tube 16, 12 is the blowing nozzle and in this case the nozzle 12 is only one.

The air current blown out continuously from the nozzle 12 is directed toward the contact point between the drum 13 and the base end of package 15 which has a bigger diameter.

In FIG. 4 and also in FIG. 5, the air current from blowing nozzles 8, 12 is directed toward the contact point described above and prevents the throwing off of a free end of yarn from a package when the yarn breaks or supply yarn is depleted.

Figure 6:
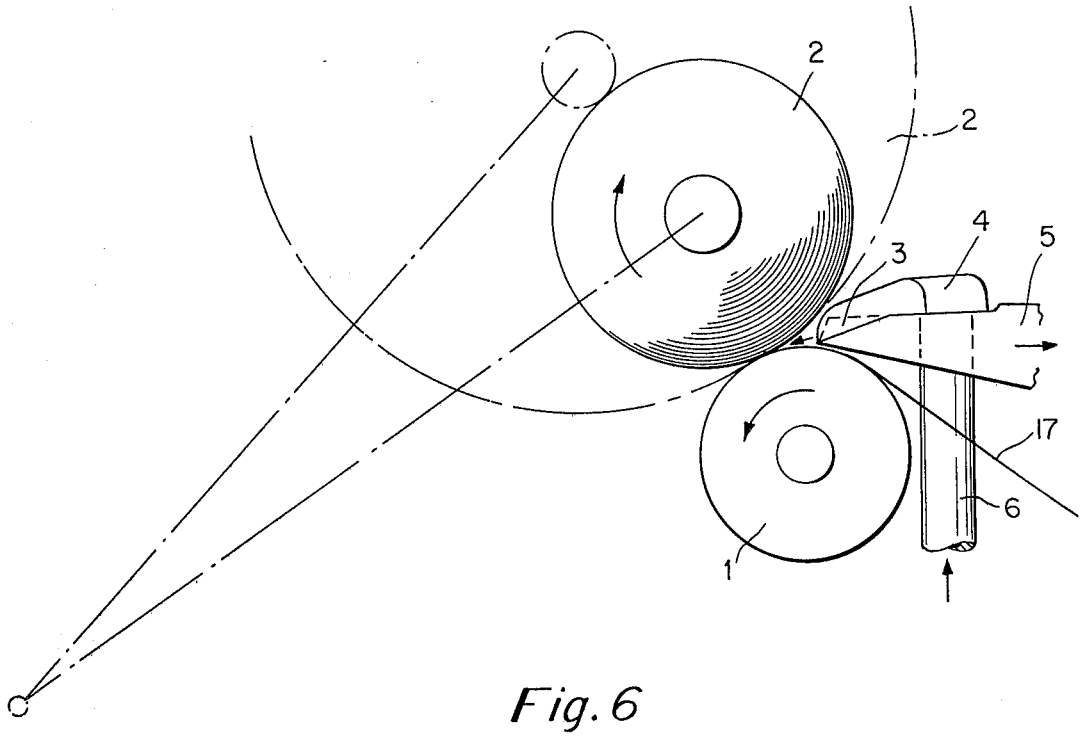
FIGS. 6, 7, and 8 show respective alternative versions of FIGS. 1, 2, and 5, but wherein the air flow is directed at right angles to the package end faces.
Figure 8:
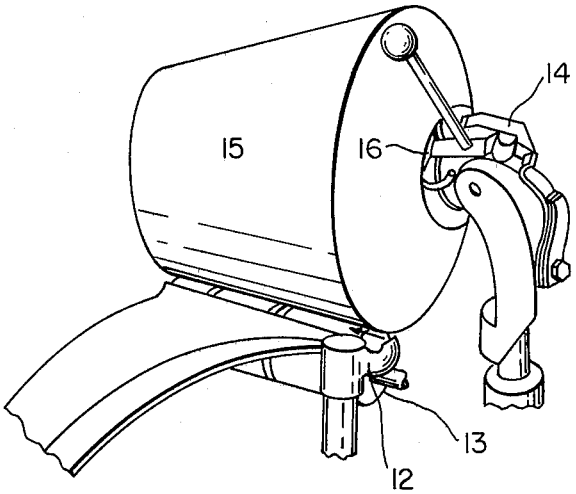
Figure 7:
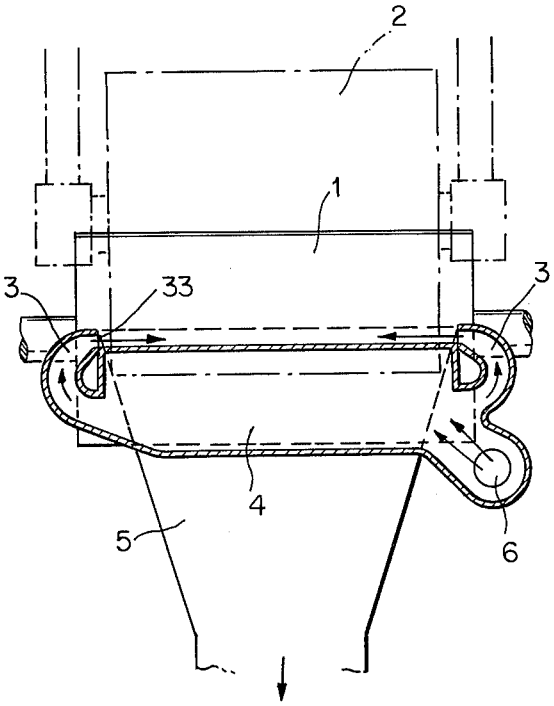
Figure 9:
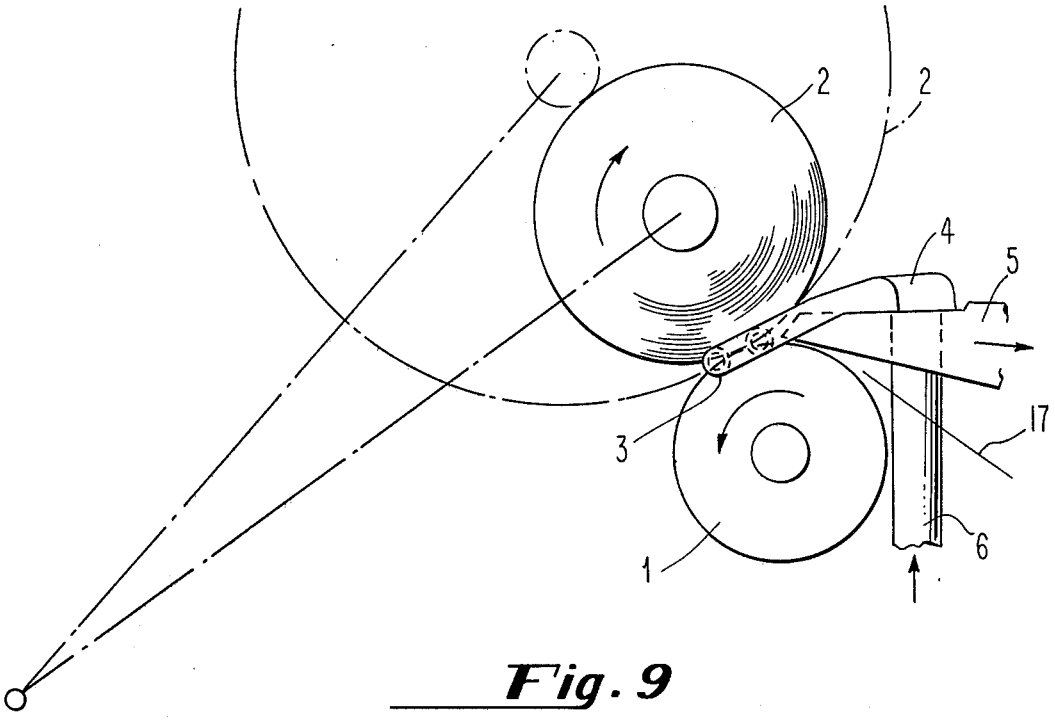
FIGS. 9 through 13 are five views in perspective showing another embodiment of the present invention, in which the blowing nozzles are arranged at both the front and the back of the contact line defined by the contact between the package and the rotating member.
Figure 10:
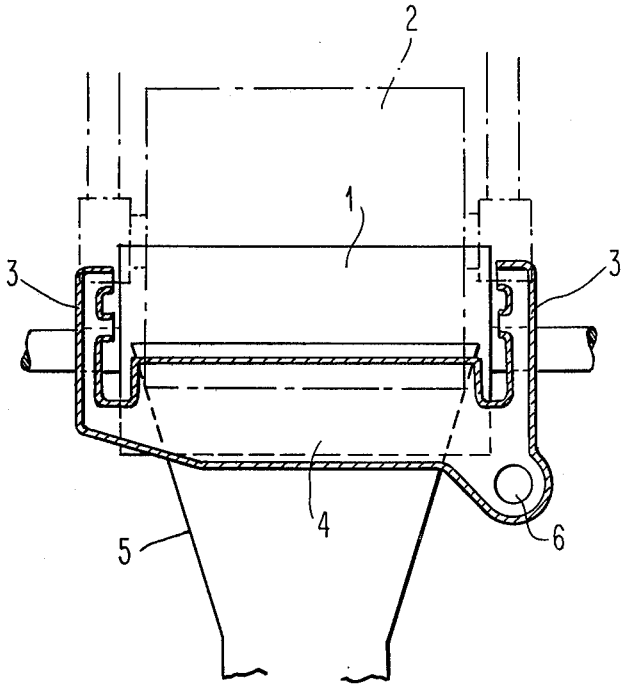
Figure 11:
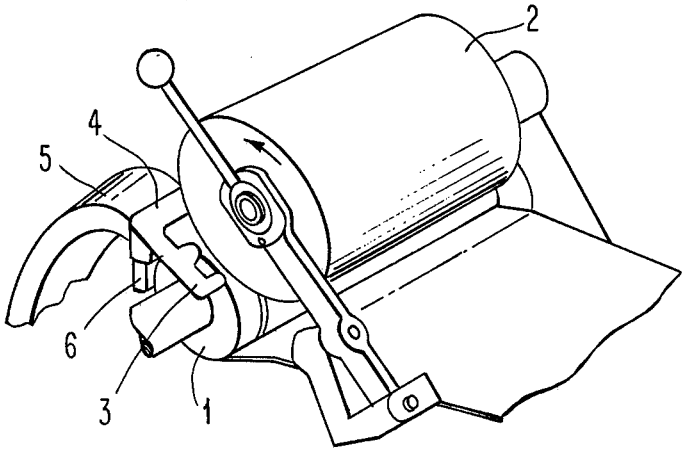

FIGS. 6, 7, and 8 show respective alternative embodiments of the FIG. 1, 2, and 5 apparatus, and all elements are accordingly numbered identically as in the counterpart embodiment. In FIGS. 6, 7, and 8 however, the nozzles 3 and 12 have their outlets such as 33 disposed substantially parallel to the end face of the package 2, whereby air currents are directed substantially at right angles to the package end faces, and substantially along and parallel to the contact line of the package 2 and the drum 1. This air current preferably is produced continuously during the entire winding operation, such that a free yarn end having no tension is blown toward the center of the package-drum contact line, traversing in axial directions with the package. Due to the location of the nozzle outlets in proximity with the package ends and to the consequent direction of air currents perpendicular to the package end faces, tailing end threads will not be forced to adhere to the package end face, but rather will be conveyed as set forth above.

The present invention is not limited to the illustrated embodiments. The device and the modification of the invention can be applied to the various types of winding machines on which a package is driven in contact with a rotating member, such as a winder having a grooved drum, or the one having a friction drive roller and a yarn traverse guide mechanism or the spindle winder provided with a rotating roller bail for applying the pressure on the package.

As mentioned above, the air current blown out from the blowing nozzle is continuously delivered during the winding operation. However, it may be stopped under the control of the automatic mechanism, at the time of an automatic knotting operation, a full package wound, and etc., that is, the normal winding operation is stopped.

What is claimed is:

1. In an automatic yarn winding machine provided with a rotating member which contacts a package, an automatically operating yarn seeking device including a suction nozzle, and an automatic knotting device, apparatus for preventing the throwing off of a loose yarn end of a package, comprising:

at least one blowing nozzle arranged at the outside of an end face of the package, said nozzle being so arranged as to provide means for continuously blowing out an air current whereby said air current is directed toward the contact point between the package and the rotating member at an approximate right angle to the end face of the package, said blowing nozzle being connected to an air chamber and mounted on said suction nozzle which comprises means to seek and seize the yarn end on the wound package when the automatic knotting operation takes place.

2. A device as set forth in claim 1, wherein said blowing nozzle is arranged at the front of the contact line between the package and the rotating member.

3. A device as set forth in claim 1, wherein said blowing nozzle is arranged at the back of the contact line between the package and the rotating member.

4. A device as set forth in claim 1, wherein said device further includes at least two blowing nozzles wherein said blowing nozzles are arranged at both the front and back of the contact line between the package and the rotating member.

5. Apparatus as set forth in claim 1, wherein the cross section of said blowing nozzle is gradually decreased from inlet to outlet.

* * * * *